US011103906B2

(12) United States Patent
Lehner et al.

(10) Patent No.: US 11,103,906 B2
(45) Date of Patent: Aug. 31, 2021

(54) COOLING SYSTEM FOR COOLING METAL ROLLING STOCK

(71) Applicants: Primetals Technologies Austria GmbH, Linz (AT); Primetals Technologies Germany GmbH, Erlangen (DE)

(72) Inventors: Christian Lehner, Gramastetten (AT); Erich Opitz, Mönchhof (AT); Lukas Pichler, Linz (AT); Florian Poeschl, Linz (AT); Alois Seilinger, Linz (AT); Klaus Weinzierl, Nuremberg (DE)

(73) Assignees: PRIMETALS TECHNOLOGIES AUSTRIA GMBH; PRIMETALS TECHNOLOGIES GERMANY GMBH

( * ) Notice: Subject to any disclaimer, the term of this patent is extended or adjusted under 35 U.S.C. 154(b) by 257 days.

(21) Appl. No.: 16/463,432

(22) PCT Filed: Nov. 28, 2017

(86) PCT No.: PCT/EP2017/080669
§ 371 (c)(1),
(2) Date: May 23, 2019

(87) PCT Pub. No.: WO2018/108518
PCT Pub. Date: Jun. 21, 2018

(65) Prior Publication Data

US 2020/0331046 A1 Oct. 22, 2020

(30) Foreign Application Priority Data

Dec. 14, 2016 (EP) ..... 16204004

(51) Int. Cl.
*B21B 45/02* (2006.01)
*C21D 1/667* (2006.01)
(Continued)

(52) U.S. Cl.
CPC ..... *B21B 45/0218* (2013.01); *B21B 37/74* (2013.01); *C21D 1/00* (2013.01); *C21D 1/62* (2013.01); *C21D 1/667* (2013.01)

(58) Field of Classification Search
CPC .. C21D 1/00; C21D 1/62; C21D 1/667; B21B 37/74
See application file for complete search history.

(56) References Cited

U.S. PATENT DOCUMENTS

2015/0053272 A1* 2/2015 Weinzierl ..... C21D 9/5735 137/14
2020/0331046 A1* 10/2020 Lehner ..... B21B 45/0218

FOREIGN PATENT DOCUMENTS

CN 202192104 U 4/2012
CN 103624093 A 3/2014
(Continued)

OTHER PUBLICATIONS

Japanese Office Action, dated Sep. 23, 2020, issued in corresponding Japanese Patent Application No. 2019-531754. English translation. Total 9 pages.
(Continued)

*Primary Examiner* — Scott R Kastler
(74) *Attorney, Agent, or Firm* — Ostrolenk Faber LLP

(57) ABSTRACT

A cooling system (2) for cooling metal rolling stock. A plurality of cooling bars (8) for applying a coolant onto the rolling stock, one dedicated coolant supply line (36) for each cooling bar (8), and a feed system (9) for guiding the coolant to the coolant supply lines (36). Each cooling bar (8) is connected to the feed system (9) via a dedicated coolant supply line (36). A bypass line (48, 52) for discharging a coolant flow from the feed system (9), is connected on the input side to a connection element (51, 53) of the feed system (9).

14 Claims, 5 Drawing Sheets

(51) Int. Cl.

| | |
|---|---|
| ***C21D 1/62*** | (2006.01) |
| ***B21B 37/74*** | (2006.01) |
| ***C21D 1/00*** | (2006.01) |

(56) References Cited

FOREIGN PATENT DOCUMENTS

| | | | |
|---|---|---|---|
| CN | 203750996 | U | 8/2014 |
| EP | 2 921 239 | A1 | 9/2015 |
| JP | S52-56052 | A | 5/1977 |
| JP | S54-79817 | A | 6/1979 |
| JP | S62-67605 | U | 4/1987 |
| JP | 2010-131644 | A | 6/2010 |
| JP | 2014-097525 | A | 5/2014 |
| SU | 1224031 | A1 | 4/1986 |
| SU | 1703213 | A1 | 1/1992 |
| WO | WO 2015/139916 | A1 | 9/2015 |

OTHER PUBLICATIONS

International Search Report dated Sep. 17, 2018 in corresponding PCT International Application No. PCT/EP2017/080669.
Written Opinion dated Sep. 17, 2018 in corresponding PCT International Application No. PCT/EP2017/080669.
European Search Report dated May 23, 2017 in corresponding European Patent Application No. 16204004.2.
Chinese Office Action, dated Feb. 25, 2020, issued in corresponding Chinese Patent Application No. 201780077797.7. English translation. Total 17 pages.
Russian Federation Office Action, dated May 27, 2021, issued in corresponding Russian Federation Patent Application No. 2019120028/05(038864). English translation. Total 15 Pages.

* cited by examiner

COOLING SYSTEM FOR COOLING METAL ROLLING STOCK

CROSS-REFERENCE TO RELATED APPLICATIONS

The present application is a 35 U.S.C. §§ 371 national phase conversion of PCT/EP2017/080669, filed Nov. 28, 2017, the contents of which are incorporated herein by reference which claims priority of European Patent Application No. 16204004-2, filed Dec. 14, 2016, the contents of which are incorporated by reference herein. The PCT International Application was published in the German language.

TECHNICAL FIELD

The invention relates to a cooling system for cooling metal rolling stock.

TECHNICAL BACKGROUND

A cooling system for cooling metal rolling stock comprises a number of cooling bars for applying a coolant to the rolling stock. Preferably, there is precisely one dedicated coolant supply line for each cooling bar and a feed line system for directing the coolant to the coolant supply lines. Each of the cooling bars is connected to the feed line system by its dedicated coolant supply line.

Such a cooling system is used to achieve defined cooling of rolling stock. For this purpose, the rolling stock is fed to the cooling system. Then a coolant, usually water, is applied to the rolling stock with the aid of the cooling bars.

In particular, in so-called hot rolling, defined cooling of the rolling stock is of central importance to achieve desired material properties of the rolling stock, for example a desired microstructure.

If there is no rolling stock in the cooling system during a pause in rolling, the coolant feed to the cooling bars is usually interrupted. Typically, one or more shut-off members of the cooling system are used for interrupting the coolant feed.

JP S54 79817 A, JP S62 67605 U and JP S52 56052 A disclose various cooling systems for cooling rolling stock which comprise a number of cooling bars or coolant nozzles for applying coolant to all of the rolling stock, coolant supply lines and feed line systems for directing coolant to the coolant supply lines.

SUMMARY OF THE INVENTION

An object of the invention is to provide an improved cooling system for cooling rolling stock.

The cooling system according to the invention comprises a plurality of cooling bars for applying a coolant to the rolling stock. The cooling system comprises a number of coolant supply lines, wherein preferably precisely one dedicated coolant supply line is provided for each cooling bar. Each coolant supply line is dedicated to one respective cooling bar, and there may be more than one of the supply lines that are dedicated to only one individual cooling bar. The cooling system also comprises a feed line system for directing the coolant to the coolant supply lines.

Each of the cooling bars is connected to the feed line system by its respective dedicated coolant supply line. In an example, each cooling bar is connected to the feed line system by its precisely one coolant supply line which is assigned to the respective cooling bar or is intended for it.

The cooling system has a bypass line for discharging a coolant flow from the feed line system. The bypass line is connected on its input side to a connection element, particularly a connection piece, of the feed line system.

The cooling system has a coolant reservoir, to which the feed line system is connected, a scale channel, a scale settling tank connected to the scale channel and a further bypass line, which is connected on its input side to another connection element of the feed line system. One of the two bypass lines is connected on its output side to the coolant reservoir or to a further connection element of the feed line system and the other of the two bypass lines opens out on the output side into the scale channel or into the scale settling tank.

The invention originates from a consideration that, upon a sudden interruption of the coolant feed, pressure surges in the cooling system, particularly in its lines, may occur. Under some circumstances, this can damage components of the cooling system and possibly lead to a failure of the cooling system. The occurrence of pressure surges that can damage the cooling system is problematic in particular whenever the cooling system is being operated in the so-called intensive cooling mode, since higher coolant pressures usually prevail in the lines of the cooling system in intensive cooling mode than occur in operation of the cooling system in the so-called laminar cooling mode.

When there is an interruption of the coolant feed to the cooling bars, the invention makes it possible for the coolant to flow away, out of the feed line system, via the bypass line. The coolant is therefore provided with an alternative flow path by the bypass line. In this way, upon an interruption of the coolant feed to the cooling bars, pressure surges in the cooling system can be avoided, or at least can be reduced. As a result, components of the cooling system can in turn be spared, and their respective service life can be increased. Expediently, when there is an interruption of the coolant feed to the cooling bars, the bypass line is enabled.

Because the bypass line is connected to a connection element of the feed line system, that a plurality of cooling bars can be bridged at once by the bypass line, i.e. a number of cooling bars can be bridged with the same bypass line. A dedicated bypass line for each of the coolant supply lines, and possibly also a dedicated shut-off member for each such bypass line, is consequently not required. This makes a structurally simple and low-cost embodiment of the cooling system possible. Moreover, operation of the cooling system that is simple in terms of control technology is made possible as a result.

In the context of the invention, a line may be understood as meaning in particular a pipe, a pipe section or a system of interconnected pipes.

The term "connected" may be understood as a short form of the expression "fluidically connected". An element of the cooling system can then be understood as connected to another element of the cooling system when a fluid, particularly the previously mentioned coolant, can flow from one of the two elements to the other of the two elements.

Applying the coolant to the rolling stock may be understood as applying the coolant to a surface of the rolling stock. The coolant may be applied to the rolling stock from one or more sides. Preferably, the coolant is applied to the rolling stock from above and from below.

The bypass line is preferably connected directly to the connection element of the feed line system or directly to the feed line system.

Expediently, the respective coolant supply line is connected (on the output side) directly to the cooling bar assigned to it. In the present case, a coolant supply line may be only one line or several lines that supplies precisely one of the cooling bars with the coolant. It is also preferred if the respective cooling bar is connected to the feed line system exclusively by way of its dedicated coolant supply line. In a preferred way, the respective coolant supply line is connected (on the input side) directly to the feed line system.

Preferably, all of the previously mentioned cooling bars are supplied with the coolant by the feed line system. The feed line system may comprise one or more lines. Preferably, the feed line system comprises at least one main line and at least one distributor line. Expediently, the main line is connected on the output side indirectly or directly to the distributor line.

It is also expedient if the coolant supply lines are connected on the input side indirectly or directly to the distributor line. On the output side, the respective coolant supply line is advantageously connected directly to the cooling bar assigned to it.

Advantageously, the cooling system comprises a coolant pump for increasing a coolant pressure in the feed line system. It is expedient if the coolant pump is arranged in the previously mentioned main line. That does not necessarily mean that, in the case of such an arrangement, the coolant pump is enclosed by the main line. For example, the main line may have a first line section which is connected to an input of the coolant pump. Moreover, the main line may have a second line section which is connected to an output of the coolant pump.

The coolant pump may be used to control the cooling capacity of the cooling system. In addition to the coolant pump, other elements of the cooling system, for example one or more control valves, may be used for controlling the cooling capacity.

By providing an alternative flow path, the bypass line makes it possible to keep the coolant in motion in the cooling system when there is an interruption of the coolant feed to the cooling bars. This means that it is not necessary to switch off the coolant pump when there is an interruption of the coolant feed. Instead, a prescribed minimum volume flow of coolant, that is delivered by the coolant pump, can be ensured even when the coolant feed to the cooling bars is interrupted.

Preferably, the coolant pump is equipped with a frequency-controlled drive, such that the coolant volume flow delivered by the pump can be set precisely. Such a coolant pump with a frequency-controlled drive may be understood as meaning a pump having a rotational speed that serves as a controlled variable.

The cooling system may also have a number of coolant pumps, particularly of the previously described type.

A preferred development of the invention provides that the cooling system has an elevated tank for storing the coolant.

Preferably, the feed line system, particularly its main line, is connected on the input side directly to the coolant reservoir or to a connection element of the coolant reservoir. The coolant is led out of the coolant reservoir by the feed line system.

The connection element of the feed line system may be an element of the main line or of the distributor line. The bypass line may be connected on the input side, particularly to the main line or the distributor line of the feed line system. Where the bypass line is connected to the main line, the bypass line is expediently connected on the input side to the main line downstream of the previously mentioned coolant pump.

The bypass line is preferably connected on the output side to the coolant reservoir and is particularly connected directly to the coolant reservoir. As a result, the coolant flow can be returned into the coolant reservoir. This enables less coolant to be introduced into the coolant reservoir by other means in order to refill it, whereby energy can be saved.

In another advantageous configuration of the invention, the bypass line is connected on the output side to a further connection element of the feed line system, particularly connected directly to the further connection element. As a result, the coolant flow can be returned into the feed line system. Less coolant has to be introduced into the coolant reservoir by other means in order to refill it, whereby energy can be saved.

The cooling system is preferably equipped with an additional connection element, which is arranged upstream of the previously mentioned coolant pump. The bypass line is connected on the output side to the additional connection element, particularly connected directly. This additional connection element may be for example the further connection element mentioned further above of the feed line system or a connection element of the coolant reservoir.

Expediently, a fluid introduced into the scale channel, in particular the coolant, can flow out of the scale channel into the scale settling tank.

In another advantageous variant of the invention, the bypass line opens out on the output side into the scale channel or into the scale settling tank. Here, the bypass line does not necessarily have to be connected to the scale channel or the scale settling tank. This means that the output of the bypass line is arranged such that the coolant flow can flow out of the bypass line into the scale channel or into the scale settling tank. For example, the output of the bypass line may be arranged above the scale channel or the scale settling tank.

The coolant in the scale settling tank may be returned to the coolant reservoir and/or into the feed line system, possibly after it has passed through a treatment system.

The further bypass line is preferably connected on the input side directly to the other connection element.

It is expedient if the cooling system has a shut-off member, in particular a valve, which is arranged in the bypass line. It is also expedient if the cooling system has at least one further shut-off member, in particular a valve, for interrupting a coolant feed to at least one of the cooling bars. Each shut-off member advantageously has at least substantially the same switching times. In this way, the opening of the bypass line can be carried out synchronously with the interrupting of the coolant feed to the cooling bars. Conversely, as a result, the closing of the bypass line can be carried out synchronously with the (renewed) enabling of the coolant feed to the cooling bars.

The switching time of a shut-off member means the time that the shut-off member requires (after a shutting or releasing command is issued) to completely close a line cross section of that line in which the shut-off member is arranged from a completely open state or to completely open the line cross section from a completely closed state.

Preferably, the further shut-off member is arranged in the feed line system, in the main line of the feed line system, or in one of the coolant supply lines.

The cooling system may also have a number of shut-off members, configured for interrupting a coolant feed to at least one of the cooling bars. A common shut-off member may be provided for a number of the cooling bars. Alternatively, a dedicated shut-off member may be provided for each of the cooling bars. For example, a shut-off member may be arranged in each of the coolant supply lines.

Expediently, an additional shut-off member, particularly a valve, is arranged in the further bypass line. The additional shut-off member arranged in the further bypass line may be formed identically to the shut-off member arranged in the first-mentioned bypass line. In particular, the additional shut-off member may have the same switching time as the shut-off member arranged in the first-mentioned bypass line.

The shut-off members are controllable or actuable with the aid of a control device. The respective shut-off member may in particular be electrically, pneumatically and/or hydraulically actuable. Preferably, the respective shut-off member can not only be opened completely and closed completely, but it can also assume intermediate positions, in particular continuous intermediate positions, between these two states. In other words, the shut-off members may be continuously adjustable.

At least one of the bypass lines may comprise a number of line sections, which are connected in parallel to one another. The line sections open out on the input side in a common line section of the respective bypass line. A shut-off member, in particular a valve, may be respectively arranged in the individual line sections connected in parallel. An advantage of such a configuration is that the shut-off members can be relatively small, and embodied with short switching times, in comparison with the configuration wherein the respective bypass line has a single shut-off member.

Furthermore, the invention relates to a method for operating a cooling system according to the invention. Furthermore, actual elements mentioned in connection with the method may be the already previously mentioned elements.

In the method hereof, by way of a bypass line, which is connected on the input side to a connection element of the feed line system, a coolant flow is discharged from the feed line system.

The first-mentioned coolant flow is sent by the first-mentioned bypass line into the coolant reservoir of the cooling system or is returned into the feed line system, in particular directly into the coolant reservoir or into the feed line system. On the other hand, the further coolant flow is advantageously sent by the further bypass line into the scale channel or into the scale settling tank of the cooling system, particularly directly into the scale channel or directly into the scale settling tank of the cooling system.

When there is no metal rolling stock to be cooled in the cooling system, the coolant flow is discharged from the feed line system via the bypass line.

The coolant flow that is discharged from the feed line system via the bypass line may be a partial flow of an overall coolant flow flowing through the feed line system or of the overall coolant flow.

The coolant flow is discharged from the feed line system via the bypass line in such a way that the coolant flow bypasses the coolant supply lines. The coolant flow is preferably sent via the bypass line in such a way that, instead of flowing into the supply lines, the coolant flow flows somewhere else, for example into another element of the cooling system or out of the cooling system. For example, coolant may be sent from the bypass line into a coolant input of the cooling system, which is positioned upstream of a coolant pump arranged in the feed line system.

In an advantageous embodiment of the invention, the coolant flow is sent from the bypass line directly into the coolant reservoir. Since this normally does not involve any contamination of the coolant, it is possible to dispense with a treatment of the coolant, so that there is no energy requirement for a treatment of the coolant sent into the coolant reservoir.

In another advantageous embodiment of the invention, the coolant flow is sent from the bypass line directly back into the feed line system. The coolant flow is preferably returned into the feed line system upstream of a coolant pump arranged in the feed line system. The coolant flow may be sent back into the feed line system from the bypass line, before an input of the coolant pump.

In advantageous variant, the further coolant flow is sent from the further bypass line directly into the scale channel or into the scale settling tank. Where the coolant is sent into the scale channel, the coolant in the scale channel is preferably passed into the scale settling tank. From the scale settling tank, the coolant therein can be returned to the coolant reservoir and/or into the feed line system. Before the coolant that is in the scale settling tank is sent (back) into the coolant reservoir and/or into the feed line system, it may be treated in a treatment system, to be cleaned of foreign bodies.

The coolant flow is also preferably discharged from the feed line system via the bypass line downstream of the coolant pump, in particular between the coolant pump and the coolant supply lines.

The description given so far of advantageous configurations of the invention includes numerous features that may expediently also be considered individually and combined into appropriate further combinations, both with the cooling system according to the invention and the method according to the invention. Thus, method features can also be regarded as properties of the corresponding device unit, and vice versa.

The properties, features and advantages of the invention described above and the manner in which they are achieved will become clearer and more clearly understandable in conjunction with the following description of the exemplary embodiments of the invention, which are explained in greater detail in conjunction with the drawings. The exemplary embodiments are used to explain the invention and do not restrict the invention to the combinations of features, including with respect to functional features, that are specified therein. For this purpose, it is furthermore also possible for suitable features of each exemplary embodiment to be considered explicitly in isolation, removed from one exemplary embodiment, introduced into another exemplary embodiment in order to supplement the latter and combined with any one of the claims.

DESCRIPTION OF EMBODIMENTS

Figure 1:
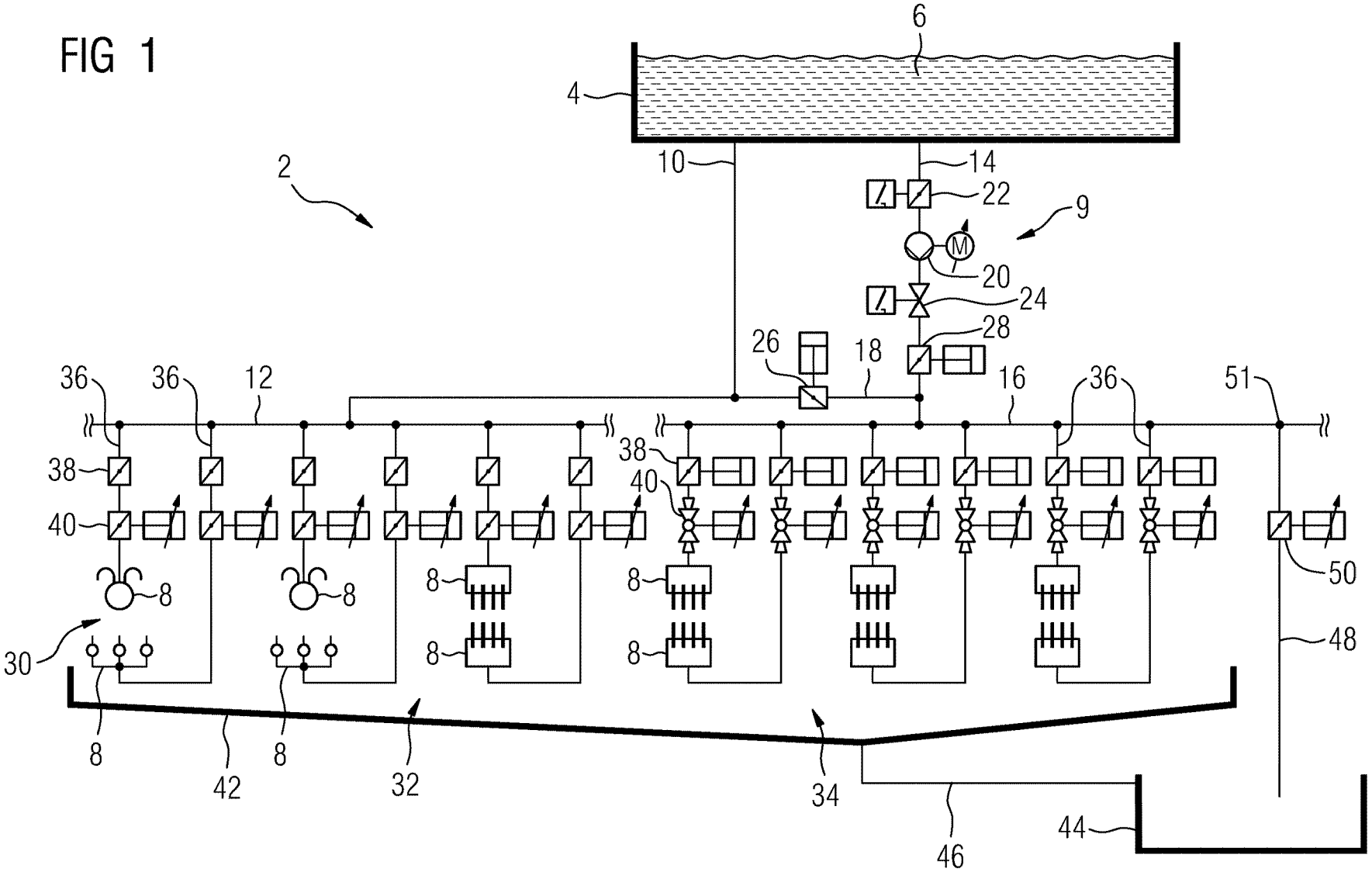
FIG. 1 shows a cooling system with a bypass line connected on the input side to a distributor line and opens out on the output side into a scale settling tank.

FIG. 1 shows a diagram of a cooling system 2 for cooling a hot-rolled rolling stock (rolling stock not represented in the figure).

The cooling system 2 comprises a coolant reservoir 4, formed as an elevated tank, for storing a coolant 6. In the present exemplary embodiment, the coolant 6 is water. The cooling system 2 also comprises a number of cooling bars 8 for applying the coolant 6 to the rolling stock. In addition, the cooling system 2 has a feed line system 9.

The feed line system 9 comprises a first main line 10 and a first distributor line 12. The first main line 10 is connected on the input side directly to the coolant reservoir 4. On the output side, the first main line 10 is connected directly to the first distributor line 12.

The feed line system 9 comprises a second main line 14 and a second distributor line 16. The second main line 14 is connected on the input side directly to the coolant reservoir 4. On the output side, the second main line 14 is connected directly to the second distributor line 16. The first main line 10 and the second main line 14 are connected to one another by a connecting line 18.

The cooling system 2 comprises a coolant pump 20, which is arranged in the second main line 14 and has a frequency-controlled drive. The coolant pump 20 is arranged between a first servicing flap valve 22 and a second servicing flap valve 24, which are arranged in the second main line 14. The servicing flap valves 22, 24 isolate the coolant pump 20 for servicing and/or repair purposes and thereby allowing servicing, repair or exchange to be performed without the coolant 6 having to be removed from upstream of the valves.

A shut-off member 26, formed as a valve, is arranged in the connecting line 18, which connects the first main line 10 to the second main line 14, for opening and closing the connecting line 18. A shut-off member 28, formed as a valve is, arranged in the second main line 14 between the coolant pump 20 and the second distributor line 16, for opening and closing the second main line 14.

The cooling bars 8 of the cooling system 2 are arranged along a cooling zone 30, through which the rolling stock is passed for its cooling. The cooling zone 30 in the present embodiment is divided into a first cooling zone section 32 and a second cooling zone section 34. The terms "first" and "second" in connection with the term "cooling zone section" distinguish between the two cooling zone sections 32, 34 of the cooling zone 30. The two sections 32, 34 may be arranged such that the rolling stock to be cooled (at least in its first pass through the cooling zone 30) is passed first through the first cooling zone section 32 and then through the second cooling zone section 34. Alternatively, the two cooling zone sections 32, 34 may be arranged so that the rolling stock (at least in its first pass through the cooling zone 30) is for example passed first through the second cooling zone section 34 and then through the first cooling zone section 32. The cooling system 2 may therefore be formed so that the second cooling zone section 34 is arranged before or after the first cooling zone section 32 in the running direction of the rolling stock.

The cooling system 2 comprises a number of coolant supply lines 36 for supplying the cooling bars 8 with the coolant, wherein there is precisely one dedicated coolant supply line 36 is provided for each of the cooling bars 8.

Each of the cooling bars 8 of the first cooling zone section 32 is connected by its dedicated coolant supply line 36 to the first distributor line 12 of the feed line system 9. In an analogous way, each of the cooling bars 8 of the second cooling zone section 34 is connected by way of its dedicated coolant supply line 36 to the second distributor line 16 of the feed line system 9. The cooling bars 8 of the first cooling zone section 32 are consequently supplied with the coolant 6 by the first distributor line 12, whereas the cooling bars 8 of the second cooling zone section 34 are supplied with the coolant 6 by the second distributor line 16.

In each of the two cooling zone sections 32, 34, one half of the cooling bars 8 are configured to apply the coolant 6 to the rolling stock to be cooled from above, while the other half of the cooling bars 8 is configured to apply the coolant 6 to the rolling stock to be cooled from below.

In the present exemplary embodiment, all of the cooling bars 8 of the second cooling zone section 34 are cooling bars of the same type of construction. These cooling bars 8 have nozzles, from which the coolant 6 leaves during the cooling operation of the cooling system 2. On the other hand, the cooling bars 8 of the first cooling zone section 32 differ from one another with regard to their type of construction. Thus, for example, some of the cooling bars 8 of the first cooling zone section 32 have coolant outlet pipes of a swan neck-like shape. In principle, all of the cooling bars 8 in the first cooling zone section 32 could also be of the same type of construction.

A servicing flap valve 38 is arranged in each of the coolant supply lines 36. In addition, a shut-off member 40, which is formed as a continuously adjustable valve and serves for controlling a coolant flow through the respective coolant supply line 36, is arranged in each of the coolant supply lines 36.

The cooling system 2 also comprises a scale channel 42, which is arranged underneath the cooling zone 30 and is intended for catching the coolant 6 coming out of the cooling bars 8 and for catching particles of scale. Furthermore, the cooling system 2 comprises a scale settling tank 44 for the deposition of particles of scale. The scale settling tank 44 is connected to the scale channel 42 by a discharge line 46, by way of which coolant 6 introduced into the scale channel 42 is directed into the scale settling tank 44 along with the particles of scale in it.

The cooling system 2 also has a bypass line 48 and a shut-off member 50 arranged therein, which is formed as a continuously adjustable valve. The bypass line 48 is connected on the input side directly to a connection element 51 of the distributor line 16. The bypass line 48 opens out on the output side into the scale settling tank 44. The shut-off member 50 arranged in the bypass line 48 and the shut-off members 40 arranged in the coolant supply lines 36 also have at least substantially the same switching times.

The second cooling zone section 34 of the cooling system 2 may optionally be operated in a laminar cooling mode, in a quasi laminar cooling mode or in an intensive cooling mode.

In the laminar cooling mode, the coolant 6 is directed from the coolant reservoir 4 by way of the first main line 10 to the coolant supply lines 36 of the first cooling zone section 32 and to the coolant supply lines 36 of the second cooling zone section 34. The shut-off member 26 arranged in the connecting line 18 is in this case open, whereas the shut-off member 28 arranged in the second main line 14 is closed. The coolant pump 20 is switched off in this cooling mode.

In the quasi laminar cooling mode and in the intensive cooling mode, the coolant 6 is directed from the coolant reservoir 4 by way of the first main line 10 to the coolant supply lines 36 of the first cooling zone section 32 and by way of the second main line 14 to the coolant supply lines 36 of the second cooling zone section 34. The shut-off member 26 arranged in the connecting line 18 is in this case closed, whereas the shut-off member 28 arranged in the second main line 14 is open.

In the laminar cooling mode all of the coolant supply lines 36 of the cooling zone 30 are supplied with the coolant 6 by the first main line 10. In the quasi laminar cooling mode and in the intensive cooling mode, on the other hand, only the coolant supply lines 36 of the first cooling zone section 32 are supplied with the coolant 6 by the first main line 10, while the coolant supply lines 36 of the second cooling zone section 34 are supplied with the coolant 6 by the second main line 14.

In the quasi laminar cooling mode, the coolant pump 20 is operated with a rotational speed at which a pressure drop in the coolant 6 that occurs as it flows through the coolant pump 20 is at least substantially compensated. On the other hand, in the intensive cooling mode, with the aid of the coolant pump 20, the coolant pressure in the second main line 14 is increased beyond the resultant pressure caused by the coolant reservoir 4.

In each of the three cooling modes, the coolant is applied to the rolling stock both by cooling bars 8 of the first cooling zone section 32 and by cooling bars 8 of the second cooling zone section 34. The cooling bars 8 of the first cooling zone section 32 are in this case always supplied with the coolant 6 by the first main line 10 and not by the second main line 14.

If there is a pause in rolling or if air is to be used (instead of the coolant) for cooling the rolling stock while the cooling system 2 is being operated in the intensive cooling mode, the coolant feed to the cooling bars 8 is interrupted with the aid of the shut-off members 40 arranged in the coolant supply lines 36. At the same time, the shut-off member 50 arranged in the bypass line 48 enables the bypass line 48.

The coolant pump 20 is in this case not switched off, but is kept in operation in order to avoid later renewed start-up of the coolant pump 20. Its rotational speed is possibly reduced, in order to reduce the coolant flow through the second main line 14.

A coolant flow from the second main line 14 is discharged by way of the bypass line 48, so that the coolant flow bypasses the coolant supply lines 36 of the second cooling zone section 34. Instead of flowing into the distributor lines 36, the coolant flow flows into the bypass line 48. By discharging the coolant flow by way of the bypass line 48, pressure surges in the present cooling system 2 are avoided, or at least reduced.

In the present exemplary embodiment, the coolant flow is not discharged by the bypass line 48 directly from the second main line 14, but by way of the second distributor line 16 connected to the second main line 14. From the bypass line 48, the coolant flow is sent directly into the scale settling tank 44. From the scale settling tank 44, the coolant 6 therein can be transferred into the coolant reservoir 4 for further use, either directly or by way of a coolant treatment system (not represented in the figures).

The descriptions of the following exemplary embodiments are in each case restricted primarily to the differences from the previous exemplary embodiment described in connection with FIG. 1, to which reference is made with respect to features and functions that remain the same. Elements that are substantially the same or correspond to one another are, where appropriate, denoted by the same reference signs and features that are not mentioned are included in the following exemplary embodiments without being described again.

Figure 2:
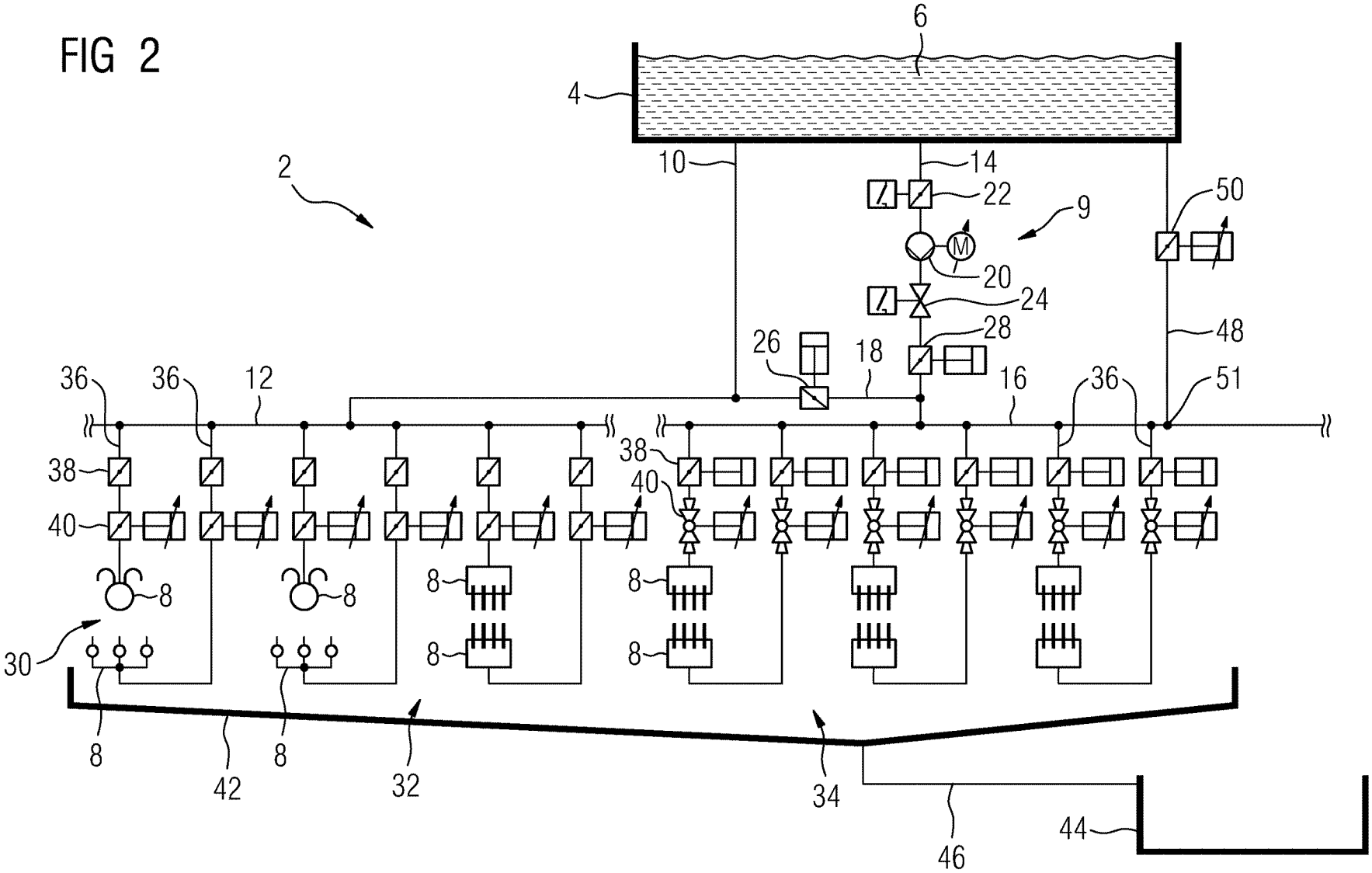
FIG. 2 shows another cooling system with a bypass line connected on the input side to a distributor line and is connected on the output side to a coolant reservoir.

FIG. 2 shows another cooling system 2 for cooling hot-rolled rolling stock. In this exemplary embodiment, the bypass line 48 is connected on the output side directly to the coolant reservoir 4. Consequently, the coolant flow discharged from the second main line 14 by way of the bypass line 48 is sent from the bypass line 48 directly into the coolant reservoir 4 (instead of into the scale settling tank 44). There is no need here for any treatment of the coolant introduced into the coolant reservoir 4 by way of the bypass line 48.

Figure 3:
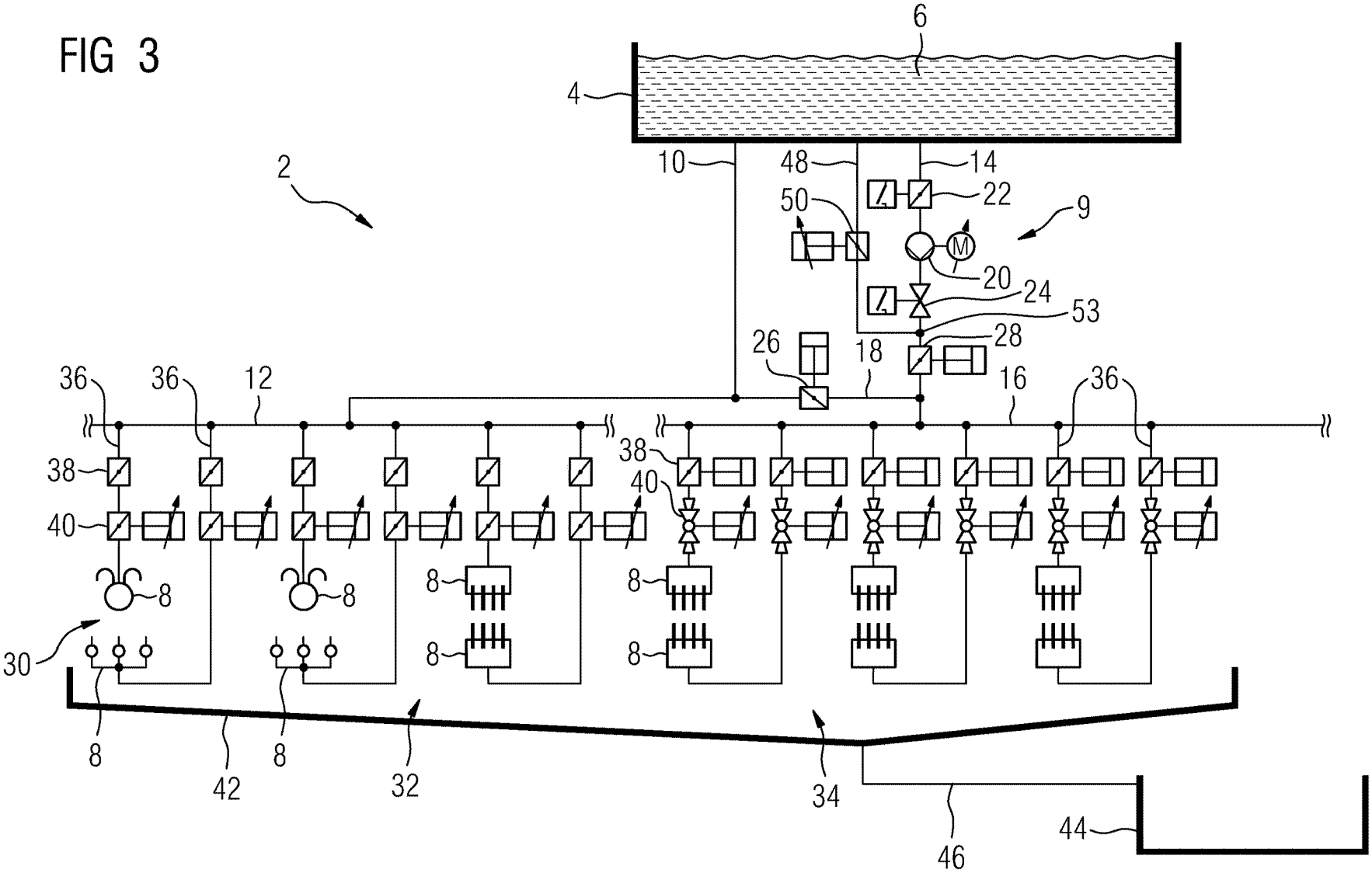
FIG. 3 shows a further cooling system with a bypass line connected on the input side to a main line and is connected on the output side to a coolant reservoir.

FIG. 3 shows a further cooling system 2 for cooling hot-rolled rolling stock. In this exemplary embodiment, the bypass line 48 is connected on the input side directly to a connection element 53 of the second main line 14. Correspondingly, in the present case, the coolant flow by way of the bypass line 48 is discharged directly from the second main line 14.

Furthermore, the bypass line 48 is connected on the output side directly to the coolant reservoir 4. Consequently, in the present exemplary embodiment, the coolant flow discharged from the second main line 14 by sent from the bypass line 48 directly into the coolant reservoir 4 (instead of into the scale settling tank 44). There is no need here for any treatment of the coolant introduced into the coolant reservoir 4 by way of the bypass line 48.

It is possible to dispense with switching off of the coolant pump 20 when there is an interruption of the coolant feed to the cooling bars 8.

Figure 4:
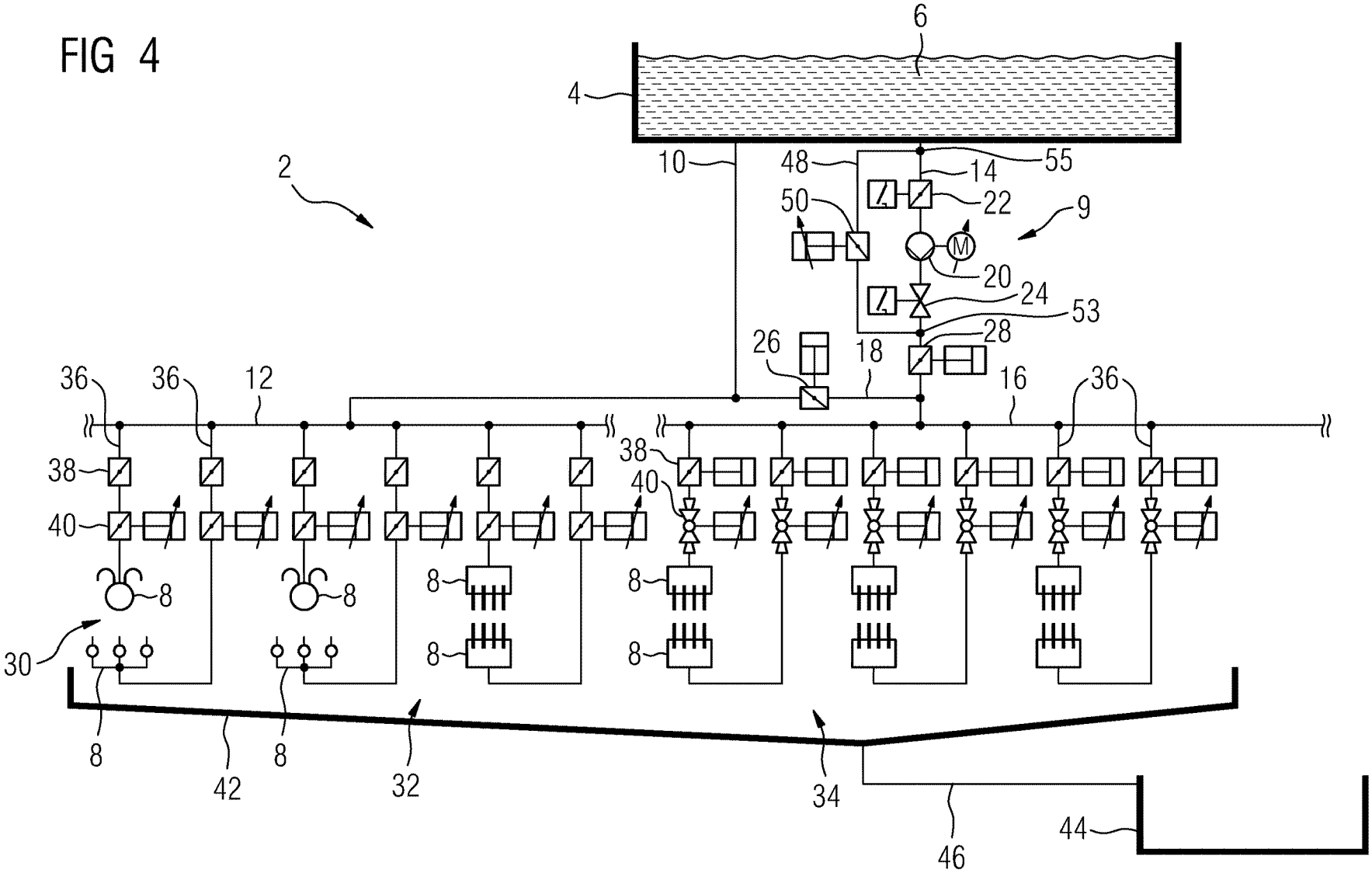
FIG. 4 shows yet another cooling system with a bypass line connected both on the input side and on the output side to a main line.

FIG. 4 shows yet another cooling system 2 for cooling hot-rolled rolling stock. In this exemplary embodiment, the bypass line 48 is connected on the input side directly to a connection element 53 of the second main line 14. Correspondingly, in the present case the coolant flow of the bypass line 48 is discharged directly from the second main line 14.

Furthermore, the bypass line 48 is connected on the output side to a further connection element 55 of the second main line 14, wherein the first-mentioned connection element 53 of the second main line 14 is arranged downstream of the coolant pump 20 and the further connection element 55 of the second main line 14 is arranged upstream of the coolant pump 20.

The coolant flow discharged from the second main line 14 by the bypass line 48 is sent back directly into the second main line from the bypass line 48 (instead of being sent into the scale settling tank 44). As long as the shut-off member 50 of the bypass line 48 is open and the shut-off members 40 of the coolant supply lines 36 of the second cooling zone section 34 are closed, the coolant pump 20 makes the coolant flow circulate in the bypass line 48 and in the second main line 14.

Figure 5:
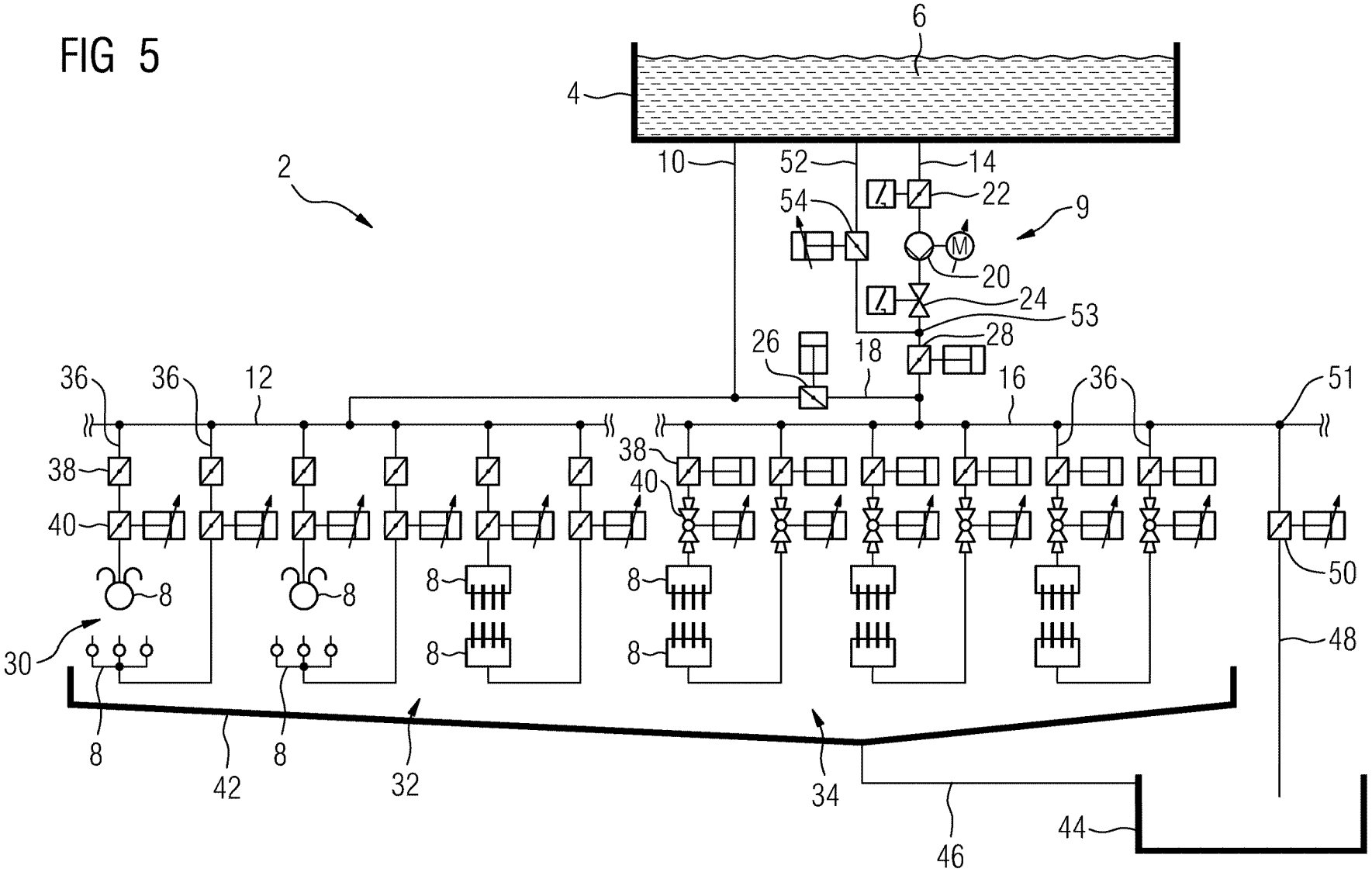
FIG. 5 shows yet a further cooling system with a first bypass line and a second bypass line, wherein the first bypass line is connected on the input side to a main line and is connected on the output side to a coolant reservoir and the second bypass line is connected on the input side to a distributor line and opens out on the output side into a scale settling tank.

FIG. 5 shows yet a further cooling system 2 for cooling hot-rolled rolling stock. The cooling system 2 comprises an additional bypass line 52 with a shut-off member 54, which is formed as a continuously adjustable valve. This bypass line 52 is connected on the input side directly to a connection element 53 of the second main line 14. On the output side, this bypass line 52 is connected directly to the coolant reservoir 4.

A further coolant flow is discharged by the additional bypass line 52 from the second main line 14, wherein the further coolant flow is sent from the additional bypass line 52 directly into the coolant reservoir 4.

In order to effectively avoid a pressure surge when there is an interruption of the coolant feed to the cooling bars 8, first the shut-off member 50 of the first bypass line 50 is opened. After that, the shut-off member 54 of the additional bypass line 52 is slowly opened and, in return, the shut-off member 50 of the first-mentioned bypass line 48 is closed again, in order that no further coolant is introduced into the scale settling tank 44. Return of the coolant previously introduced into the scale settling tank 44 and then into the coolant reservoir 4 involves a higher energy expenditure than a direct return of the coolant from the second main line 14 into the coolant reservoir 4.

A combination of a number of bypass lines is also possible in the case of the exemplary embodiments from FIG. 1 to FIG. 4. In particular, in the exemplary embodiments from FIG. 1 to FIG. 3, in addition to the bypass line 48 respectively disclosed there, a bypass line 48 as in FIG. 1 may be provided.

Although the invention has been illustrated more specifically and described in detail by the preferred exemplary embodiments, the invention is not restricted by the examples disclosed and other variations may be derived therefrom without departing from the scope of protection of the invention.

List of Designations

2 Cooling system
4 Coolant reservoir
6 Coolant
8 Cooling bars
9 Feed line system
10 Main line
12 Distributor line
14 Main line
16 Distributor line
18 Connecting line
20 Coolant pump
22 Servicing flap valve
24 Servicing flap valve
26 Shut-off member
28 Shut-off member
30 Cooling zone
32 Cooling zone section
34 Cooling zone section
36 Supply line
38 Servicing flap valve
40 Shut-off member
42 Scale channel
44 Scale settling tank
46 Discharge line
48 Bypass line
50 Shut-off member
51 Connection element
52 Bypass line
53 Connection element
54 Shut-off member
55 Connection element

The invention claimed is:

1. A cooling system (2) for cooling metal rolling stock, comprising:

a plurality of cooling bars (8) configured for applying a coolant to the rolling stock;

a respective dedicated coolant supply line (36) for each of the cooling bars (8);

a feed line system (9) for directing the coolant to the respective dedicated coolant supply lines (36), wherein each of the cooling bars (8) is connected to the feed line system (9) by its dedicated coolant supply line (36);

a bypass line (48, 52) for discharging a coolant flow from the feed line system (9), the bypass line is connected on an input side to a connection element (51,53) of the feed line system (9);

a coolant reservoir (4), to which the feed line system (9) is connected;

a scale channel (42), a scale settling tank (44) connected to the scale channel (42); and a further bypass line (48, 52) connected on the input side to another connection element (51, 53) of the feed line system (9), wherein one of the two bypass lines (48, 52) is connected on an output side to the coolant reservoir (4) or to a further connection element (55) of the feed line system (9) and the other of the two bypass lines (48, 52) opens out on a further output side into the scale channel (42) or into the scale settling tank (44).

2. The cooling system (2) as claimed in claim 1, wherein the coolant reservoir (4) is an elevated tank.

3. The cooling system (2) as claimed in claim 1, wherein the bypass line (48, 52) is connected on the output side to the coolant reservoir (4).

4. The cooling system (2) as claimed in claim 1, wherein the bypass line (48, 52) is connected on the output side to the further connection element (55) of the feed line system (9).

5. The cooling system (2) as claimed in claim 1, further comprising:

a coolant pump (20) configured for increasing a coolant pressure in the feed line system (9), wherein the further connection element (55) is arranged upstream of the coolant pump (20) and the bypass line (48, 52) is connected on the output side to the additional connection element (55); and the coolant pump (20) has a frequency-controlled drive.

6. The cooling system (2) as claimed in claim 1, wherein the bypass line (48, 52) opens out on the output side into the scale channel (42) or into the scale settling tank (44).

7. The cooling system (2) as claimed in claim 1, further comprising a shut-off member (50, 54) arranged in the bypass line (48, 52), and at least one further shut-off member (40) for interrupting a coolant feed to at least one of the cooling bars (8).

8. The cooling system (2) as claimed in claim 7, further comprising the shut-off member (50, 54) which is arranged in the bypass line (48, 52) and the further shut-off member (40) are both configured to have at least substantially the same switching times.

9. The cooling system (2) as claimed in claim 7, further comprising the further shut-off member (40) is arranged in the feed line system (9) or in one of the coolant supply lines (36).

10. A method for operating a cooling system (2) as claimed in claim 1, comprising:

discharging a coolant flow from the feed line system (9) via the bypass line (48, 52), which is connected on the input side to the connection element (51, 53) of the feed line system (9);

sending the coolant flow via the bypass line (48, 52) into the coolant reservoir (4) of the cooling system (2) or sending the coolant flow back into the feed line system (9); and sending a further coolant flow is via the further bypass line (48,52) into the scale channel (42) into the scale settling tank (44) of the cooling system (2).

11. The method as claimed in claim 10, further comprising sending the coolant flow from the bypass line (48, 52) directly into the coolant reservoir (4) of the cooling system (2).

12. The method as claimed in claim 10, further comprising sending the coolant flow from the bypass line (48, 52) directly back into the feed line system (9), so that the coolant flow is reintroduced into the feed line system (9) upstream of a coolant pump (20) arranged in the feed line system (9).

13. The method as claimed in claim 10, further comprising sending the further coolant flow from the further bypass line (48, 52) directly into a scale channel (42) or into a scale settling tank (44) of the cooling system (2).

14. The cooling system as claimed in claim 1, wherein there is precisely one of the respective coolant supply lines (36) for each of the cooling bars.

* * * * *